United States Patent [19]

Economopoulos

[11] Patent Number: 4,702,812

[45] Date of Patent: Oct. 27, 1987

[54] ELECTROLYTIC APPARATUS AND A METHOD OF OPERATING IT

[75] Inventor: Marios Economopoulos, Liege, Belgium

[73] Assignee: Centre de Recherche Metallurgiques-Centrum Voor Research in de Metallurgie, Brussels, Belgium

[21] Appl. No.: 918,040

[22] Filed: Oct. 14, 1986

[30] Foreign Application Priority Data

Oct. 15, 1985 [LU] Luxembourg ..... 86119

[51] Int. Cl.[4] ..... C25D 17/00

[52] U.S. Cl. ..... 204/208; 204/210

[58] Field of Search ..... 204/208, 210, 216, 273

[56] References Cited

U.S. PATENT DOCUMENTS 4,174,261 11/1979 Pellegrino ..... 204/273

4,529,486 7/1985 Polan ..... 204/216

FOREIGN PATENT DOCUMENTS 7713296 2/1977 France ..... 204/28

*Primary Examiner*—T. M. Tufariello

*Attorney, Agent, or Firm*—Holman & Stern

[57] ABSTRACT

An anode arranged very close to a cathode in an electrolytic circuit is constituted by a plate formed with first and second sets of orifices, both distributed over the surface of the plate. The first set is connected to electrolyte supply means and the second set to electrolyte discharge means with the aim of producing high turbulence in the narrow space between the anode and cathode.

6 Claims, 4 Drawing Figures

ELECTROLYTIC APPARATUS AND A METHOD OF OPERATING IT

BACKGROUND OF THE INVENTION

1. Field of Invention

The invention relates to electrolytic apparatus and to electro-deposition of a metallic substance onto a substrate.

2. Description of Prior Art

Electro-deposition is a method which has long been used for forming adherent plating or thin non-adherent plating which can subsequently be separated from the substrate as an extra-thin foil.

As is known, in this method the speed of deposition of the metal depends inter alia on the current density used, and the practical obtainment of the current density is in return related to the "turbulence" of the electrolyte.

As is also known, the cost of an electrolysis operation depends inter alia on the potential difference between the electrodes, which can be lowered by decreasing the distance between the electrodes.

If the electrolysis operation is to be economic, therefore, the electrolyte must be conveyed at high speeds between two electrodes which are as close as possible.

The problem has already received various solutions, mainly consisting in sending the electrode at a tangent or perpendicular to the surfaces of the electrodes present. These solutions, however, are applicable only to small electrodes. When the surfaces are large, as e.g. when coating a wide steel plate or strip or during manufacture of wide thin foils by electroforming, the pressure drops are enormous owing to the small flow section and the large distance travelled by the electrolyte. In such cases, very powerful pumps have to apply very high pressures to drive the electrolyte. These pressures in turn exert considerable forces on the electrodes and may deform them, resulting in uncontrollable variation in their spacing and destroying the uniformity of electrolysis.

SUMMARY OF THE INVENTION

The invention is concerned with means for economically ensuring high turbulence in an electrolyte between two very close electrodes, without using excessive driving pressures.

The invention provides apparatus for electro-deposition on a substrate or for electrolytic treatment, adapted to produce high turbulence of the electrolyte between an anode very close (less than 1 cm, preferably less than 5 mm) to a cathode, the cathode usually being the substrate, the apparatus comprising a plate formed with a first set of orifices distributed over the plate surface and connected to electrolyte supply means, and a second set of orifices likewise distributed over the plate surface and near the first set of orifices, the second set being connected to electrolyte discharge means, and the plate constitutes the anode of the electrolytic circuit.

In one embodiment, the plate cooperates with a number of other walls to form a box which bounds a closed internal space and comprises:

(a) at least one orifice or inlet port extending through a wall of the box and giving access to the internal space, and (b) tubes connected to the second set of orifices and extending through the internal space without communicating therewith and opening outside the box.

In another embodiment, the tubes connected to the second set of orifices are connected at their other ends to suction means, e.g. a pump, via a collector.

The preferred apparatus may be operated as follows: the box, connected to the negative terminal of a DC source, is disposed so that its wall formed with the two sets of orifices is near the surface of the substrate connected to the negative terminal of the same DC source.

The electrolyte is introduced at moderate pressure into the space inside the box via the inlet port. As a result of the supply pressure, the electrolyte leaves the box through the first set of orifices and flows in the narrow space between the box wall and the substrate, i.e. between the anode and cathode. After a short journey in this space, the electrolyte is taken up by the second set of orifices, e.g. by suction, and conveyed to a sufficient distance from the substrate, through the tubes connected to these orifices. It can then be re-introduced into the box, if necessary after regeneration, and travel again through the circuit as described.

The invention will be described further, by way of example, with reference to the accompanying drawings.

BRIEF DESCRIPTION OF THE DRAWINGS

In the drawings, like elements are always denoted by like reference numbers.

DESCRIPTION OF PREFERRED EMBODIMENTS

Figure 1:
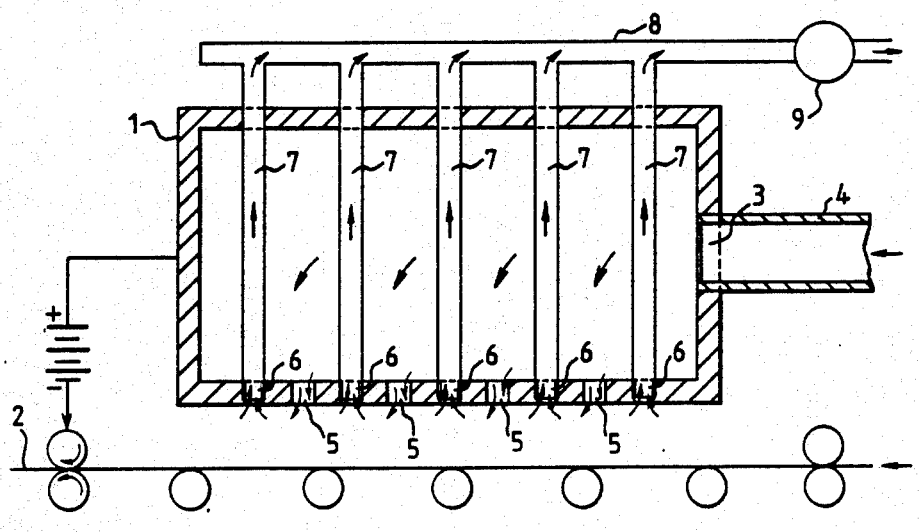
FIG. 1 is a diagram of a box used for plating a flat surface, such as one surface of a strip.

Referring firstly to FIG. 1, a first embodiment of apparatus according to the invention comprises a box 1, one wall of which constitutes a flat plate disposed parallel and very close to the surface of a moving metal strip 2 (the distance being exaggerated in the drawing). A side wall of the box 1 has an inlet port 3 connected to a duct 4 for supplying an electrolyte under pressure from a source (not shown).

The wall of the box 1 facing the strip 2 is formed with a first set of orifices 5 connecting the space inside box 1 to the narrow space between box 1 and strip 2. The same wall is formed with a second set of orifices 6 (intercalated with the first set) connected to tubes 7 which extend through the interior of the box 1 and emerge in sealing-tight manner through another wall of the box 1. In the embodiment illustrated in FIG. 1, the tubes open into a collector 8 which can be connected to a discharging pump 9.

In order to form an electrolytic deposit on the strip 2, the strip is connected to the negative terminal of a DC source, or if necessary to ground, whereas the box 1 is connected to the positive terminal of the same DC source. The box then constitutes the anode and the strip constitutes the cathode of an electrolysis circuit.

In FIG. 1, the electric connections are shown diagrammatically, since the technology of these connections is well-known.

The electrolyte enters the exterior of the box 1 through the inlet port 3 connected to the duct 4. As a result of the supply pressure, the electrolyte fills the interior of the box, then flows out through the orifices 5 to fill the narrow space between box 1 and strip 2. An electric current can thus flow between the anode (box 1) and cathode (strip 2) and bring about the desired electro-deposition on strip 2. Owing to the short distance between the orifices 5 and the orifices 6, the electrolyte is very quickly taken up by suction through the orifices 6 and the tubes 7 to the collector 8 and the pump 9. After being regenerated if necessary and topped up by known means (not shown) the electrolyte is then returned, by the action of the pump 9, into the supply duct 4 and re-circulates.

In a preferred variant the suction devices, i.e. collector 8 and pump 9, are completely eliminated. The box 1 is completely immersed in the tank (not shown) containing the electrolyte, and the tubes 7 open directly into the tank. The electrolyte then flows through the tubes 7 as a result of the pressure in the narrow space between the anode and the cathode. Owing to the shortness of the journey by the electrolyte in the narrow space between box and substrate, i.e. between an orifice 5 and an adjacent orifice 6, the pressure drop opposing the electrolyte flow is greatly reduced.

The pressure for bringing about the flow is therefore lower than in prior art solutions. Also, the electrolyte is taken up almost immediately through orifices 6, thus preventing or greatly limiting lateral flow of electrolyte.

The above-described embodiment relates more particularly to plating of flat products such as strips. Of course, the invention is not limited to this kind of product and its use also extends to plating of products having any cross section, by using plates, inter alia walls of the box, which intimately follow the shape of the substrate.

The apparatus according to the invention can also be used for depositing non-adherent plating which can be detached from the substrate to obtain very thin foils.

Figure 2:
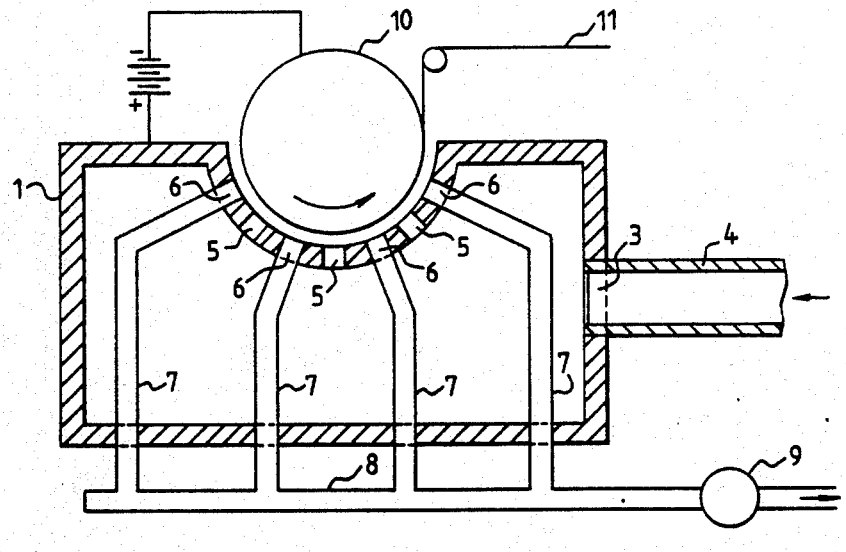
FIG. 2 shows a box used for forming an extra-thin foil by non-adherent deposition onto a rotary cylinder.

FIG. 2 illustrates this application of the invention.

FIG. 2 shows a box 1 having one wall defining a semi-cylindrical cavity formed with orifices 5 and 6 as previously described. The orifices 6 are connected to a collector 8 by tubes 7. The semi-cylindrical cavity contains a cylinder 10, coaxial with and adapted to rotate in the cavity. The outer diameter of the cylinder 10 is slightly less than the diameter of the cavity, so that a narrow semi-annular slot (exaggerated in FIG. 2) is left between them. The box 1 and the cylinder 10 are connected to the positive and negative terminals, respectively, of a DC source. The electrolyte is introduced through a supply duct 4 and travels via the orifices 5 into the semi-annular slot, where it undergoes electrolysis, and is then taken up by the orifices 6 and the tubes 7 to the collector 8. The non-adherent metal foil 11 formed on the cylinder 10 is then detached in known manner.

Tests made by the applicants have shown that the installations shown in FIGS. 1 and 2 have a number of advantages over known devices.

The following description relates more particularly to the manufacture of extra-thin foils by the installation in FIG. 2. However, the described effects and advantages are equally true when the installation in FIG. 1 is used for plating.

From the hydraulic view point, tests have confirmed that the shortening of the hydraulic path of the electrolyte is an excellent method of reducing pressure between the electrodes.

The present apparatus reached a specific flow rate of electrolyte of 20 $l/m^2$. s at a pressure of 1 $kg/cm^2$ with an anode-cathode spacing of 0.1 mm. This specific flow rate ensures high turbulence, which in turn improves the electrical properties of the installation.

Figure 3:
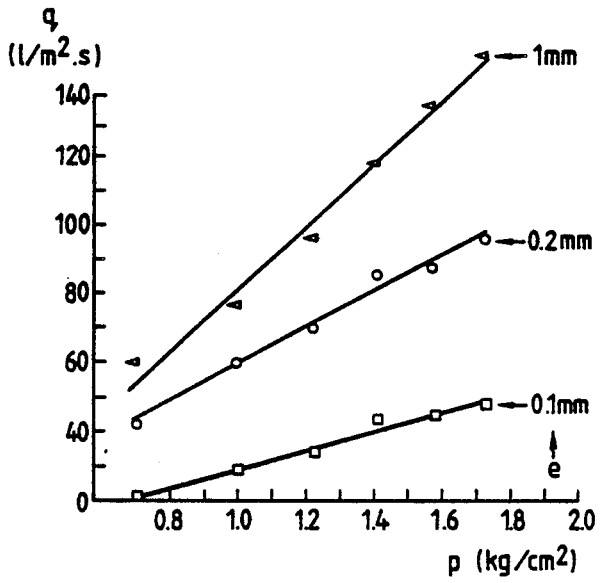
FIG. 3 shows the variation in the specific flow rate of electrolyte with pressure between the electrode, for various distances between anode and cathode.

FIG. 3 shows the variation in specific flow rate (g) of electrolyte with pressure (p), for various distances (e) between anode and cathode. It clearly shows that the present apparatus can greatly reduce this distance while ensuring appreciable specific flow rates and without needing excessive pressures.

Figure 4:
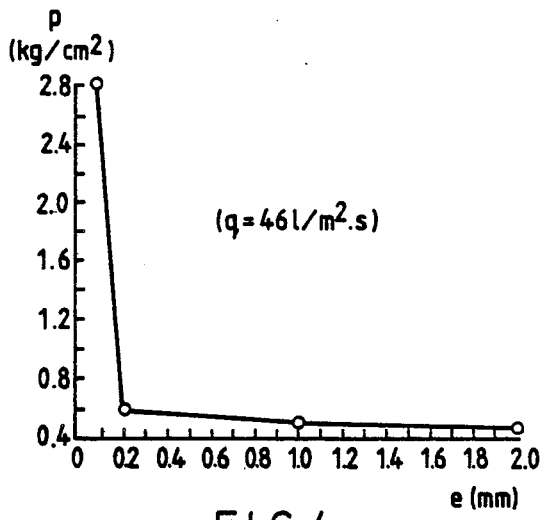
FIG. 4 shows the effect of the anode-cathode distance on the electrolyte pressure between the electrodes, at a constant specific flow rate of electrolyte.

This characteristic is illustrated by the graph in FIG. 4, which shows the effect of the anode-cathode distance (e) on the electrolyte pressure (p) ensuring a predetermined specific flow rate.

At a constant specific flow rate q equal to 46 $l/m^2$.s, the apparatus was used to lower the anode-cathode distance to 0.2 mm, whereas the pressure rose only from 0.4 to 0.6 $kg/cm^2$.

With regard to the electrical aspect of manufacturing extra thin foil, the tests have also stressed the importance of the current density (D) and the turbulence of the electrolyte during deposition. If all the other conditions are constant, these two parameters largely determine the cohesion and surface quality of the resulting extra-thin foil. As already stated in the introduction to the present application, the practical obtainment of the current density also depends on the flow speed of the electrolyte, i.e. ultimately on its specific flow rate. If a suitable increase is made in the specific flow rate at a constant anode-cathode distance, the present apparatus can produce perfectly sound extra thin foils at current densities considerably above 100 $A/dm^2$.

The apparatus described above is also advantageous in this respect, since an increase in current density can be used to increase the speed and consequently the productivity of the production lines, when manufacturing a given thickness of extra-thin foil.

Another advantage of the apparatus is that it can achieve high turbulence and current-density levels using low pressures. Consequently the anode and the substrate are not subjected to large forces and are therefore not appreciably deformed. The energy consumed by the pump is also low.

The increase in turbulence brought about by the apparatus also results in a decrease in the apparent resistivity of the electrolytic cell. For example at a given anode-cathode distance of 1 mm, an increase in electrolyte pressure from 0.5 to 1 $kg/cm^2$ resulted in an increase in specific flow rate from 53.9 to 80 $l/m^2$.s and a decrease in the apparent resistivity of the electrolytic cell from 2.21 ohm-cm to 1.43 ohm-dm. The result is an additional reduction in energy consumption during deposition.

In the preceding description, reference has systematically been made to an electrolyte supply through the first row of orifices whereas the electrolyte is taken up and returned through the second row of orifices and the tubes associated therewith. More particularly it has been proposed to use a box for this supply. Without departing from the invention, however, the orifices of either set could be supplied by directly connecting them to individual supply pipes in the absence of any box. The supply pipes could then in turn be connected, individually or in groups, to a source of electrolyte. The other set of orifices will then advantageously be provided with tubes for returning the electrolyte.

The apparatus can also be used for varying the width of the plated area of substrate of the width of the extra-thin foil, by modifying the length of the box 1 or the cylinder 10, in the transverse direction of the product. This modification can be made e.g. by varying the number of boxes juxtaposed across the width of the product or by dividing a long box into a number of separately supplied and discharged compartments, or in blocking some of the orifices through which the electrolyte travels.

Finally, various apparatuses according to the invention can be combined for simultaneously plating both surfaces of a single flat product, more particularly a strip, with different substances if required, or for plating one surface of two flat products, or for simultaneously producing a number of foils from a single electrolytic solution.

In the case where an extra-thin foil (e.g. less than 20 μm thick) is manufactured. the foil-forming operation may advantageously be followed, in line, by heat-treatment for fixing its properties. Owing to the very wide use of this kind of product in the packing industry, one essential property is its ease of folding, which means that the elastic limit must be small and there must be no spring effect after folding.

To this end, a method according to the invention can comprise a heat-treatment operation including a first step of heating the extra thin foil above its recrystallization temperature followed by a step of rapid cooling to a temperature near ambient temperature. The term "near ambient temperature" means a temperature at which the extra-thin foil does not undergo further metallurgical transformation.

In practice, the heating temperature is above about 650° C. in order to recrystallize the metal and thus improve its ductility by reducing its elastic limit and breaking load compared with the levels observed immediately after electroforming. The preheating step is preferably brought about by direct resistance heating.

Rapid cooling can be produced e.g. by immersing the extra-thin foil in an aqueous quenching bath which can be at a temperature above ambient temperature. The rapid cooling has a softening effect on the extra-thin foil, making it easier to fold. The amount of softening depends of course on the purity of the metal forming the sheet, more particularly on its free carbon and nitrogen content.

By way of example, an extra-thin sheet (10 μm) foil of iron containing less than 0.002 wt. % carbon and less than 0.0007 wt. % nitrogen was recrystallised by heating and holding between 650° and 850° C., then cooled at about 5600° C./s by immersion in boiling water. It was thus given excellent foldability without springyness and without losing any flatness or surface appearance.

An extra-thin iron foil produced and heat-treated by the method according to the invention is at least as easy to fold as the aluminum sheets at present in use.

The apparatus and method according to the invention can be used to manufacture plated products, more particularly high-quality extra-thin sheets, at a high production rate and with limited energy consumption.

These excellent results have been achieved by combining the two basic features of the invention. i.e. high turbulence of the electrolyte and a very short hydraulic path between the electrodes. The high turbulence is due to the fact that the electrolyte, which has a high momentum, arrives perpendicular to the surface of the substrate or cathode, and spreads between the anode and cathode before being very rapidly taken up through the discharge orifices. Under these conditions there is practically no laminar flow parallel to the electrodes. It is also generally thought that the turbulence of the electrolyte depends on its flow rate between the electrodes. According to the invention, however, can give a high turbulence can be achieved without requiring large flow rates of electrolyte. Also, the required pressure is low and consequently the pump power and energy consumption are limited. The hydraulic path is very short owing to the short distance between the supply orifices and the discharge orifices. It is possible to discharge practically all the electrolyte through the discharge orifices: consequently there is no appreciable lateral flow and the apparatus has the important practical advantage of not requiring lateral seals.

I claim:

1. Electrolytic apparatus comprising an electrolytic circuit including an anode and a cathode very close to the anode; means for producing high turbulence in an electrolyte between the anode and the cathode, said means comprising a plate constituting the anode and having a first set of orifices distributed over the surface of the plate and a second set of orifices distributed over the surface of the plate near the first set of orifices, electrolyte supply means connected to the first set of orifices, and electrolyte discharge means connected to the second set of orifices; a substrate and means for separating from the substrate a foil formed thereon by electrolysis of the electrolyte; heating means for heating the foil to a temperature above its recrystallisation temperature, and means for rapidly cooling the foil to a temperature near ambient temperature.

2. Apparatus as claimed in claim 1, further comprising a box which has a wall constituting the plate and other walls which bound a closed internal space, at least one of the said other walls having at least one inlet port giving access to the internal space, and tubes connected at one end to the second set of orifices and extending through the internal space without communicating therewith and opening outside the box.

3. Apparatus as claimed in claim 2, in which at least some of the said tubes have their other ends connected to suction means.

4. Apparatus as claimed in claim 3, in which the suction means comprise a collector and a pump.

5. Apparatus as claimed in claim 1, including individual supply pipes connected to the respective orifices of one of the two sets of orifices, a source of electrolyte connected to the supply pipes, and tubes connected to the other set of orifices for returning the electrolyte.

6. Apparatus as claimed in claim 1, in which the substrate constitutes the cathode.

* * * * *